United States Patent [19]

Lucey et al.

[11] Patent Number: 4,687,911

[45] Date of Patent: Aug. 18, 1987

[54] ELECTRIC FURNACE HEATER

[75] Inventors: Willard J. Lucey, Woburn; Arthur Waugh, Winchester, both of Mass.

[73] Assignee: BTU Engineering Corporation, North Billerica, Mass.

[21] Appl. No.: 749,573

[22] Filed: Jun. 27, 1985

[51] Int. Cl.[4] ..... H05B 3/10

[52] U.S. Cl. ..... 219/553; 338/208; 338/294; 373/134

[58] Field of Search ..... 219/532, 538, 539, 541, 219/545, 553, 390; 338/208, 261, 298, 299, 325, 294; 373/128, 130, 134, 117; 174/128 R, 730, 127, 146

[56] References Cited

U.S. PATENT DOCUMENTS

| | | | |
|---|---|---|---|
| 1,190,135 | 7/1916 | Faccioli | 174/127 |
| 2,412,843 | 1/1944 | Spraragen | 219/46 |
| 2,533,409 | 12/1950 | Tice | 219/19 |
| 2,759,092 | 8/1956 | Fortin | 219/46 |
| 3,047,701 | 5/1960 | Frungel | 219/19 |
| 3,060,303 | 7/1958 | Skoglund et al. | 219/46 |
| 3,178,665 | 8/1962 | Matheson et al. | 338/299 |
| 3,420,986 | 12/1966 | Pohler et al. | 219/553 |
| 3,425,020 | 1/1967 | Toyooka et al. | 338/208 |
| 3,427,547 | 12/1965 | Matheson et al. | 338/208 |
| 3,469,013 | 9/1969 | Hetherington et al. | 373/117 |
| 3,541,303 | 11/1967 | Brinkman et al. | 219/374 |
| 3,946,194 | 3/1976 | de la Bretoniere | 219/213 |
| 4,238,636 | 12/1980 | Burstrom | 338/298 X |

*Primary Examiner*—L. T. Hix
*Assistant Examiner*—Brian W. Brown
*Attorney, Agent, or Firm*—Weingarten, Schurgin, Gagnebin & Hayes

[57] ABSTRACT

A generally cylindrical, self-supporting, unitary high-temperature electrical resistance heating element is disclosed. The heating element is composed of a wire grate formed from a plurality of electrically continuous and intersecting wire segments made of electrical resistance wire. The configuration of the heating element can be maintained by a plurality of circular rings made of conductive wire and placed orthogonally at intermediate points along the length of the heating element and which can serve as electrical terminals. The resulting heating element offers advantages of low weight, high efficiency and minimal thermal inertia, and provides a unitary heater structure which provides the ability to have different temperature zones along its length.

9 Claims, 4 Drawing Figures

ELECTRIC FURNACE HEATER

FIELD OF THE INVENTION

The present invention relates generally to high-temperature electrical heating elements, and more particularly, to a cylindrical, self-supporting electrical resistance heater formed of a grate of resistance wire.

BACKGROUND OF THE INVENTION

In high temperature furnaces employed in the heat processing of materials and products, electrical heating elements are usually employed. A plurality of individual heating elements can be provided along the length of the furnace, the elements being electrically energized to provide heating of the furnace chamber. Different combinations of the heating elements can be arranged and energized to provide zones of different temperature. Furnace heaters are also known which are effectively continuous in length and comprise an electrical resistor ribbon wound in a helical or circuitous path and which is provided in encircling or confronting relationship with the furnace chamber. These ribbon-type heaters are supported on an insulative structure which adds to the overall weight and thermal inertia of the heater assembly. In addition, the heater is comprised of a single resistance ribbon, and the entire heater assembly is heated to the same temperature. For different temperature zones, a separate heater would be provided for each zone. Moreover, a break in the ribbon will result in an open circuit of the entire heater.

SUMMARY OF THE INVENTION

In accordance with the present invention, an electric furnace heater is provided which has relatively low weight, low thermal inertia, and which is substantially self-supporting over its entire area and capable of providing different temperature zones along its length. The heater is of unitary construction, having a wire grate formed from a plurality of electrically continuous and intersecting wire segments. A plurality of circular rings of conductive wire disposed at intermediate points along the length of the heater serve as electrical terminals and provide zones of different temperature such that along the single unitary structure different temperature zones are produced.

DESCRIPTION OF THE DRAWINGS

Other advantages and features of the present invention will become apparent as the invention becomes better understood by referring to the following exemplary and non-limiting detailed description of the preferred embodiment, and to the drawings, wherein.

DESCRIPTION OF THE PREFERRED EMBODIMENT

Figure 1:
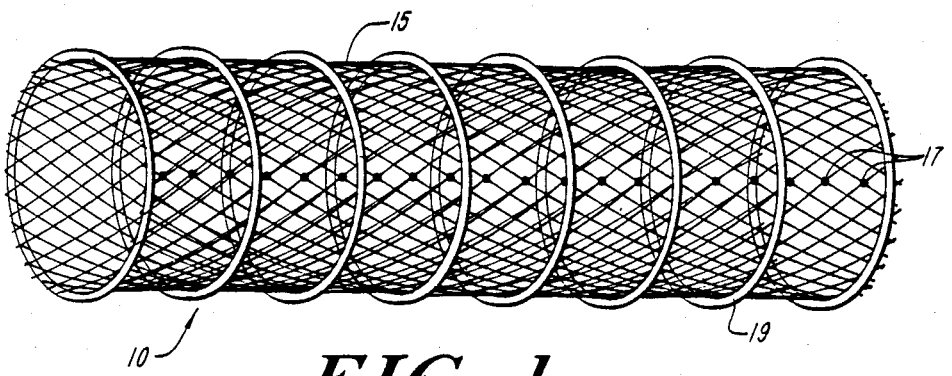
FIG. 1 is a perspective view of one embodiment of an electrical heater of the present invention.
Figure 2:
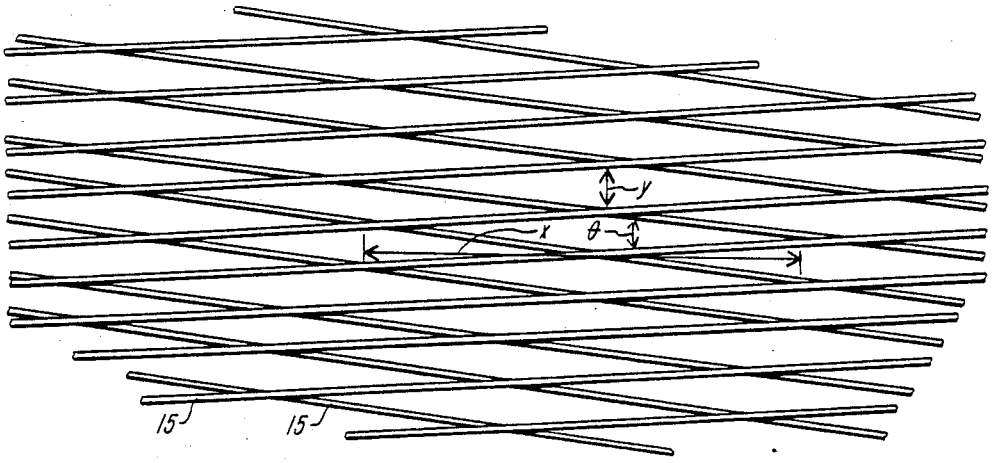
FIG. 2 is an enlarged fragmentary view of a portion of the electrical heater of FIG. 1.

Referring now to FIGS. 1 and 2, there is shown the improved electric heating element of the present invention. The heating element, generally designated 10, comprises a plurality of resistance wires 15 helically wrapped into a cylindrical shape so as to create a metal grate. At each point of overlap, electrical contact is made. In the present invention, such contact is provided by welding the wires together at the numerous points of overlap. Wires 15 are typically an 18-gauge Nikrothal-8 wire, although it is apparent that any metal wire with suitable characteristics will work.

The dimensions of the grate are determined by equations well-known in the art, and depend on variables such as the power input, the resistance of the metal, and the length and diameter of the overall heater. The angle of overlap, $\theta$, which is shown in FIG. 2, is arrived at from mathematical formulas for determining power (watts), resistance (ohms), and watt-loading (watts per square inch). Power distribution within the heating chamber can be controlled by varying the pitch of the helically wrapped wires.

There are several alternative methods for constructing the electric heater 10. In one method, a flat grate is first constructed from overlapping wires in which each overlapping point is welded into a mechanically and electrically integral contact. The flat grate is then cut to the desired dimensions and rolled into a cylindrical shape with the desired diameter. The respective edges of the grate are thereafter welded together at the points designated 17 in FIG. 1.

In a second alternative method for constructing the electric heater 10, the wires 15 are helically wrapped around a cylindrical mandrel. After a first wire is wrapped, each subsequently wrapped wire is welded at each intersecting and overlapping point.

Rings 19 of conductive wire can be provided intermediate the ends of the heater and electrically connected to the confronting wire portions of the grate. These rings are operative to serve as electrical terminals to control the power distribution along the length of the heater, and to aid in support of the grate. Each longitudinal section between pairs of rings can be at a different power level such that zones of different temperatures can be created throughout the length of the unitary heating element. By varying the spacing between rings 19, temperature regions of varying lengths can be made. In a preferred embodiment, rings 19 are made of a heavy gauge wire, such as 8- or 10-gauge Nikrothal-8 wire.

Power distribution within region can also be adjusted by removing wires from or adding them to zones between adjacent rings. This causes power adjustment by either reducing or increasing the number of wires producing heat in a particular zone.

Figure 4:
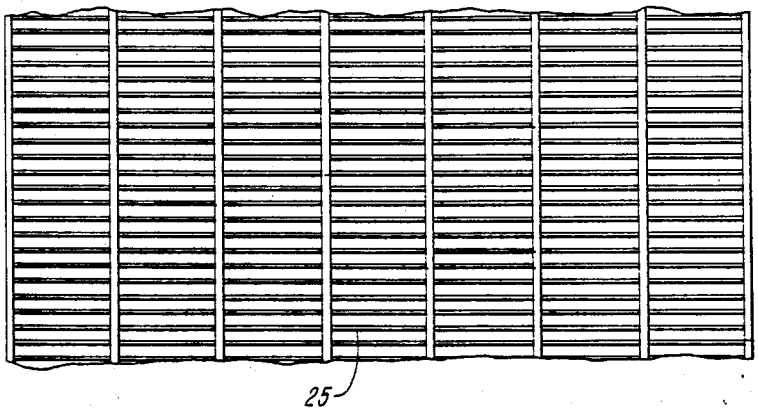
FIG. 4 is an enlarged fragmentary view of a portion of the electrical heater of FIG. 3.
Figure 3:
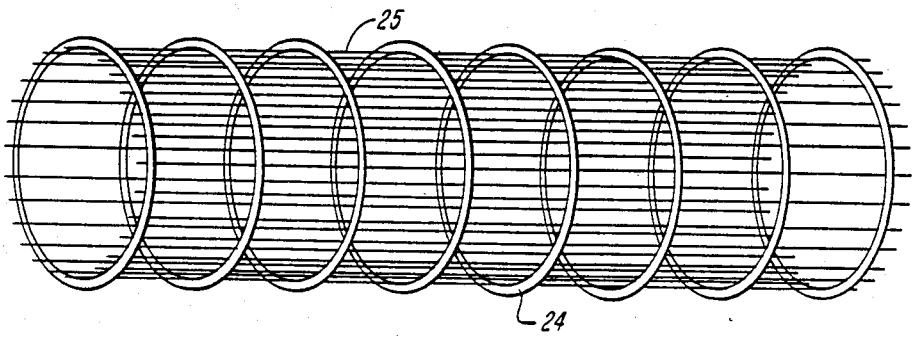
FIG. 3 is a perspective view of another embodiment of the electrical heater of the present invention.

FIGS. 3 and 4 show another embodiment of the electrical heater of the present invention. This embodiment employs an array of longitudinal wires generally parallel to the axis. These wires are interconnected by conductive rings 29 in order to interconnect each of the parallel wires at intermediate points. The longitudinal wires 25 in this embodiment are typically 18-gauge Nikrothal-8 wire, and the wire rings are typically a heavier 8- or 10-gauge Nikrothal-8 wire.

The rectangular grate of the second embodiment can be constructed by first manufacturing a flat grate with both the 18-gauge and heavier gauge wire. At each point of overlap, the wires are welded together. After the flat grate is formed, an appropriate length is cut and rolled into the desired shape, with the confronting ends of the orthogonal wire rings 29 welded together. Wires 25 can thereafter be selectively removed from or added to separate longitudinal zones, to permit adjustment of the power distribution along the length of the heating element.

The end and intermediate rings can be connected to a suitable power source by appropriate terminals. The heater and terminals can, if desired, be contained in a surrounding thermally insulated material.

It will be readily apparent to those skilled in the art that the principles of this invention may be embodied in different configurations to suit particular heating and installation requirements.

What is claimed is:

1. An electrical heating element which is substantially self-supporting and has an adjustable heat profile along a unitary length, comprising:

a plurality of resistance wires so spaced as to form a cylinder;

at least three rings of conductive material circumferentially placed around said parallel resistance wires in such a spaced-apart relation that each pair of adjacent rings serves as mechanical support and as electrical terminals for said resistance wires therebetween;

said rings being spaced at predetermined positions to provide an intended power level for the resistance wires connected therebetween such that a temperature profile is provided along the length of the heating element as determined by said predetermined positions of said rings;

said parallel resistance wires being of sufficient gauge to form a self-supporting grate along the length of said cylinder; and said rings being comprised of a conductive material of heavier gauge than said resistance wires.

2. The electrical heating element of claim 1 wherein a portion of said plurality of substantially parallel resistance wires are helically wound in a right-hand spiral to form a portion of said cylinder, and the remaining portion of said plurality of substantially parallel resistance wires are helically wound in a left-hand spiral;

the wires of the left and right hand helixes individually intersecting each other at plural intersections; and said resistance wires being electrically interconnected at each overlapping intersection.

3. The electrical heating element of claim 1 wherein said plurality of resistance wires are parallel to the longitudinal axis of said cylinder.

4. The method of making an electrical heating element which is substantially self-supporting and has an adjustable heat profile along a unitary length, comprising:.

forming a flat wire grate by crossing a first plurality of substantially parallel resistance wires with a second plurality of substantially parallel wires creating intersections;

electrically and mechanically interconnecting at each intersection the several crossing wires;

rolling said grate into an open cylinder; and electrically and mechanically connecting opposite edges of said rolled grate to form a closed cylinder.

5. The method of claim 4, further including the step of encircling said closed cylinder with at least three rings of conductive material circumferentially placed around said cylinder; and electrically connecting said rings to each of said resistance wires such that each pair of adjacent rings serves as electrical terminals for said resistance wires therebetween.

6. The method of making the heating element of claim 4 wherein said forming step includes placing said first plurality of resistance wires perpendicular to said second plurality of wires; and forming said second plurality of wires into conductive rings to provide mechanical support and to act as electrical terminals for the plurality of resistance wires between adjacent rings.

7. The method of claim 4 wherein said second plurality of wires are of the same material and gauge as said first plurality of resistance wires.

8. The method of claim 7 wherein said adjustable heat profile is adjusted by means of altering the number of resistance wires connected between adjacent rings.

9. The method of claim 8 wherein said adjustable heat profile is further adjusted by means of varying the distance between adjacent rings.

* * * * *